US007000993B2

(12) United States Patent
Lee

(10) Patent No.: US 7,000,993 B2
(45) Date of Patent: Feb. 21, 2006

(54) FURNITURE PIECE

(75) Inventor: Steve Lee, Chicago, IL (US)

(73) Assignee: LumiSource, Inc., Elk Grove Village, IL (US)

( * ) Notice: Subject to any disclaimer, the term of this patent is extended or adjusted under 35 U.S.C. 154(b) by 0 days.

(21) Appl. No.: 10/744,940

(22) Filed: Dec. 23, 2003

(65) Prior Publication Data

US 2005/0140197 A1 Jun. 30, 2005

(51) Int. Cl.
*A47C 4/00* (2006.01)

(52) U.S. Cl. ..... 297/378.12; 297/188.1; 297/181; 297/17

(58) Field of Classification Search ..... 297/188.1, 297/378.12, 181, 228.13, 440.15, 17, 188.08, 297/188.09, 452.16, 440.14; 5/420, 722
See application file for complete search history.

(56) References Cited

U.S. PATENT DOCUMENTS 1,767,925 A * 6/1930 Hargreaves ..... 190/8
2,693,846 A * 11/1954 Luttio ..... 297/105
3,775,785 A * 12/1973 Mittendorf ..... 5/640
3,817,574 A * 6/1974 McNab ..... 297/188.04
3,902,759 A * 9/1975 Monteforte et al. ... 297/452.16
3,951,453 A * 4/1976 Zapf ..... 297/440.15
4,036,524 A * 7/1977 Takamatsu ..... 297/219.1
4,079,992 A * 3/1978 Thrift et al. ..... 297/183.5
4,460,188 A * 7/1984 Maloof ..... 280/30
4,518,203 A * 5/1985 White ..... 297/452.16
4,528,706 A * 7/1985 Branker ..... 5/722
4,635,306 A * 1/1987 Willey ..... 5/632
4,802,249 A * 2/1989 Bills ..... 5/420
4,883,317 A * 11/1989 Davenport ..... 297/188.1
D330,639 S * 11/1992 Munro et al. ..... D6/335
5,299,337 A * 4/1994 Venza ..... 5/656
D356,250 S * 3/1995 Chang ..... D9/323
5,622,404 A * 4/1997 Menne ..... 297/188.1
5,727,844 A * 3/1998 O'Quinn et al. ..... 297/217.1
5,785,383 A * 7/1998 Otero ..... 297/255
5,816,650 A * 10/1998 Lucas, Jr. ..... 297/188.1
6,155,647 A * 12/2000 Albecker, III ..... 297/452.16
6,206,463 B1 * 3/2001 Whigham ..... 297/129
6,270,155 B1 * 8/2001 Rashid ..... 297/1
6,341,817 B1 * 1/2002 Stern-Gonzalez ..... 297/188.1
6,419,313 B1 * 7/2002 Newman ..... 297/188.1
2002/0005649 A1 * 1/2002 Hofmann et al. ..... 296/37.15

FOREIGN PATENT DOCUMENTS

DE 3408248 A1 * 9/1985

* cited by examiner

*Primary Examiner*—Peter R. Brown
*Assistant Examiner*—Stephen D'Adamo
(74) *Attorney, Agent, or Firm*—Pauley Petersen & Erickson

(57) ABSTRACT

A furniture piece including a base and a backrest pivotally connected to the base. An attachment component is positionable or movable between an engaged position locking the backrest in an upright position and a disengaged position allowing the backrest to move towards a folded position. A seat portion is pivotally connected to the base, and pivotally movable with respect to the base between an open position and a closed position. With the backrest in the folded position, the furniture piece may be placed within a box and shipped and/or stored in a volume-efficient manner.

12 Claims, 5 Drawing Sheets

FURNITURE PIECE

BACKGROUND OF THE INVENTION

1. Field of the Invention

This invention relates to a furniture piece that includes a base and a backrest that can be secured in an upright position or folded with respect to the base for easy and efficient shipping and/or storage.

2. Description of Related Art

Conventional furniture pieces are typically built on a rigid frame. Relatively large boxes or packaging are required in order to ship and/or store the furniture pieces, thereby limiting the number of pieces that can be shipped to a location and/or stored at the location. There is an apparent need for a furniture piece that can be folded to make more efficient and simplify shipping and/or storing of the furniture piece.

SUMMARY OF THE INVENTION

It is one object of this invention to provide a furniture piece that may be easily shipped and/or stored.

It is another object of this invention to provide a furniture piece having a backrest that may be folded with respect to a base.

It is still another object of this invention to provide an attachment component that can be used to lock or secure the backrest in an upright or first position with respect to the base, and to allow the backrest to be moved or pushed towards a folded or second position with respect to the base.

The above and other objects of this invention can be attained by a furniture piece, which includes a base and a backrest pivotally connected to the base. The backrest is pivotally movable with respect to the base between an upright or first position and a folded or second position. An attachment component is positionable or movable between an engaged position, which locks or secures the backrest in the upright position, and a disengaged position, which allows a user to move or push the backrest towards the folded position and fold the backrest with respect to the base. Preferably but not necessarily, the furniture piece further includes a seat portion pivotally connected to the base. The seat portion is pivotally movable with respect to the base between an open position and a closed position. Preferably, the seat portion is pivoted with respect to the base, to expose or to close a compartment formed within or by the base.

In one preferred embodiment of this invention, in a folded position at least a portion of the backrest contacts the seat portion. In the folded position, a top of the backrest is generally coterminous with a front of the base. In an alternate preferred embodiment of this invention, the backrest is foldable into a folded positioned wherein at least a portion of the backrest is contained within the compartment. Preferably but not necessarily, in the folded position, the backrest is entirely contained within the compartment. With the backrest contained within the compartment, the seat portion is positioned to close the compartment. In the closed position of this embodiment, the seat portion covers the backrest for easy and efficient shipping and/or storage of the furniture piece.

In order to provide an easy and efficient furniture piece for shipping and/or storage, the backrest can be unlocked from the upright position and pivoted or otherwise moved towards the folded position. The backrest is folded with respect to the base and the furniture piece can be volume-efficiently positioned into a shipping box or package.

Other objects and advantages of this invention are apparent to those skilled in the art, in view of the following detailed description taken in conjunction with the appended claims and drawings.

BRIEF DESCRIPTION OF THE DRAWINGS

The drawings show a furniture piece, according to one preferred embodiment of this invention, wherein.

DETAILED DESCRIPTION OF PREFERRED EMBODIMENTS

Figure 1:
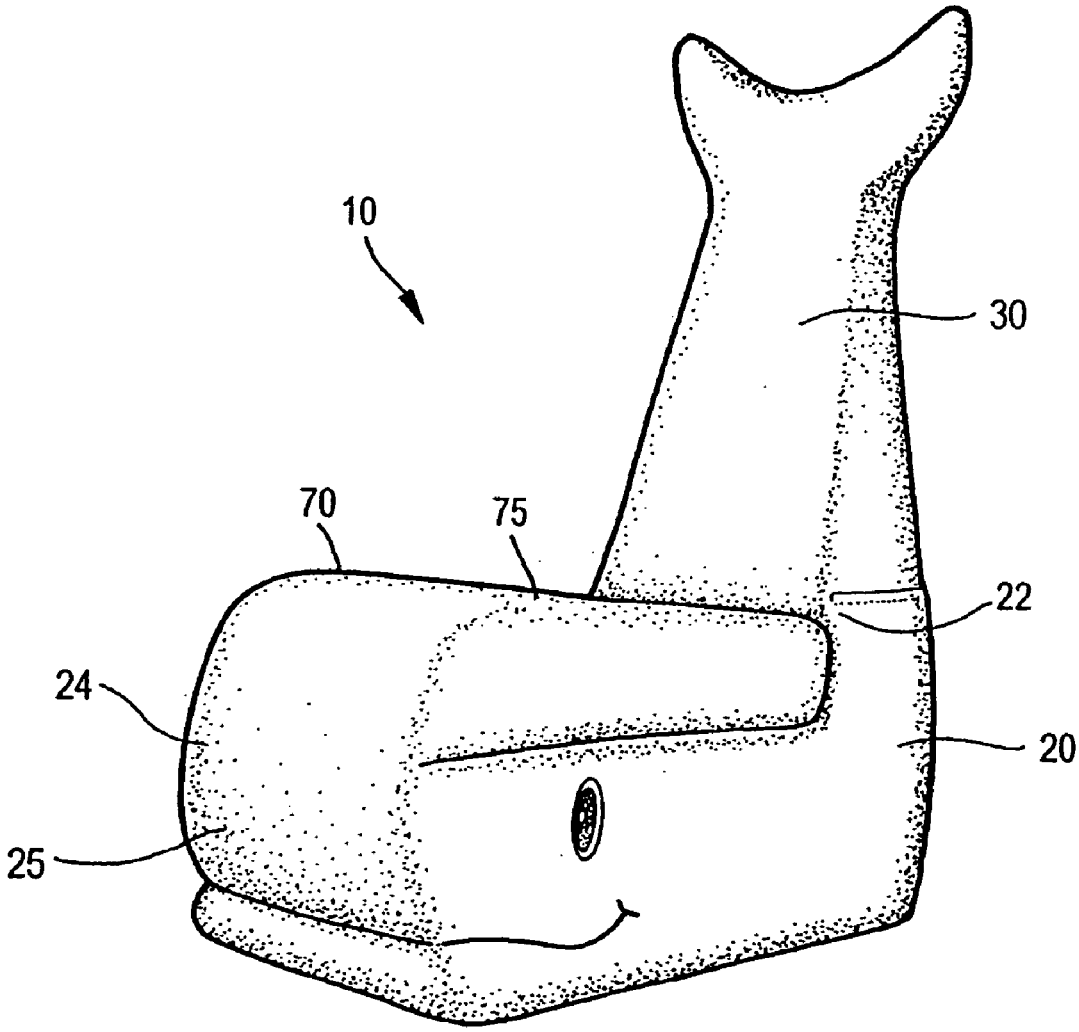
FIG. 1 is a front perspective view of a furniture piece, according to one preferred embodiment of this invention.

FIGS. 1–5 show a furniture piece 10 according to one preferred embodiment of this invention. As shown in FIG. 1, furniture piece 10 is formed as a chair. As known to those skilled in the art, furniture piece 10 may form any other suitable furniture piece including, but not limited to, a couch or a sofa. Further, furniture piece 10 may have any suitable or desirable shape, configuration and/or size. For example, furniture piece 10 may comprise a chair shaped as a whale, as shown in FIGS. 1–5, or furniture piece 10 may resemble any suitable or desirable animal or other character, in shape, configuration and/or size.

Preferably, furniture piece 10 comprises a base 20 and a backrest 30 pivotally connected to base 20. Backrest 30 is pivotally connected to base 20 at a first end portion 22 of base 20 and pivotally movable with respect to base 20 between an upright position, as shown in FIGS. 1–4, and a folded position, as shown in F*ig*. 5. Backrest 30 can be pivotally connected to base 20 using any suitable mechanical connection that allows backrest 30 to pivot or otherwise move with respect to base 20, such as one or more hinges. In one preferred embodiment of this invention, the suitable mechanical connection limits the pivotal movement of backrest 30 in at least one direction, such as a backward direction with respect to base 20.

Figure 2:
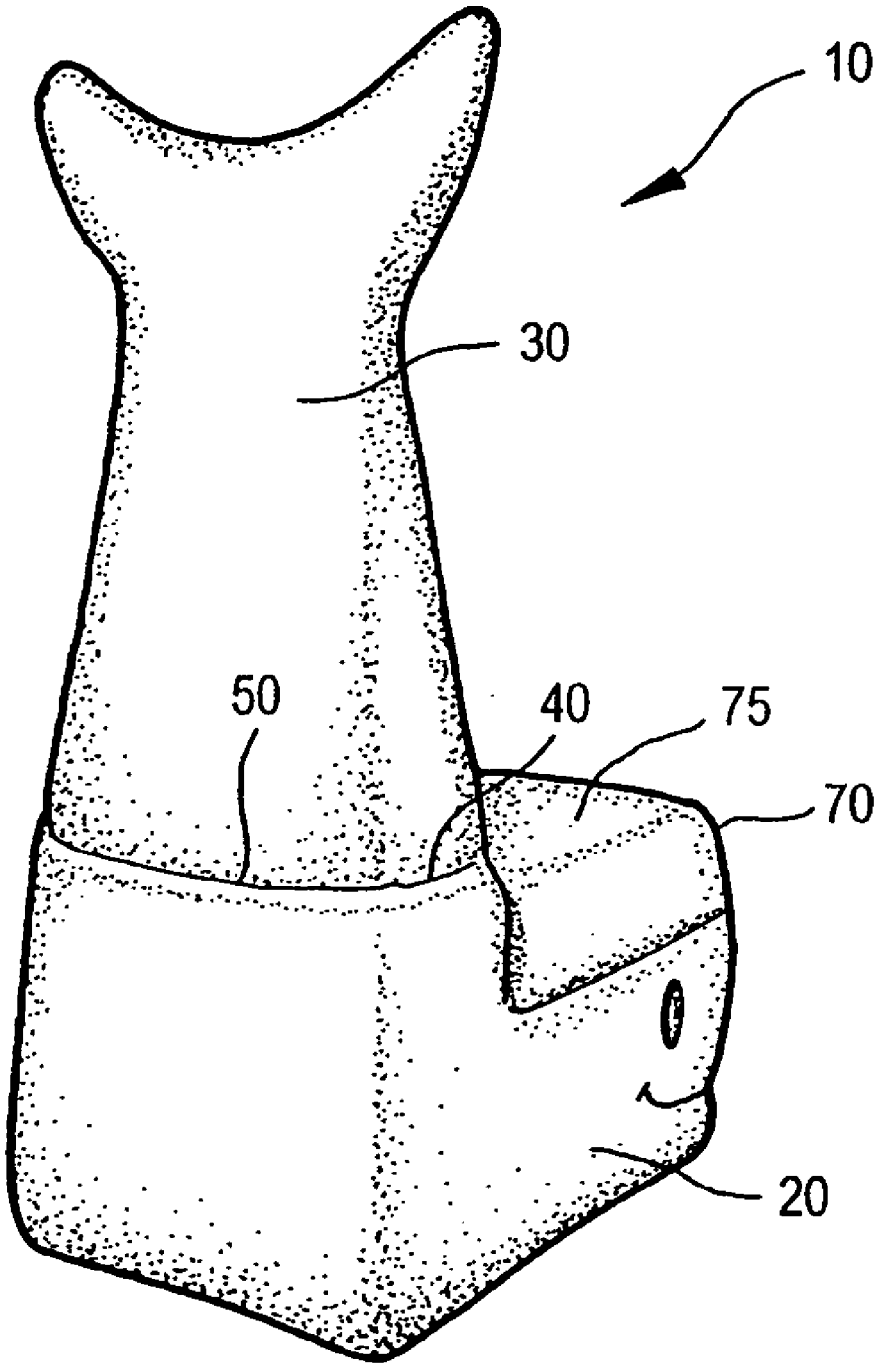
FIG. 2 is a back perspective view of a furniture piece showing an attachment component positioned on a backrest of the furniture piece, according to one preferred embodiment of this invention.
Figure 3:
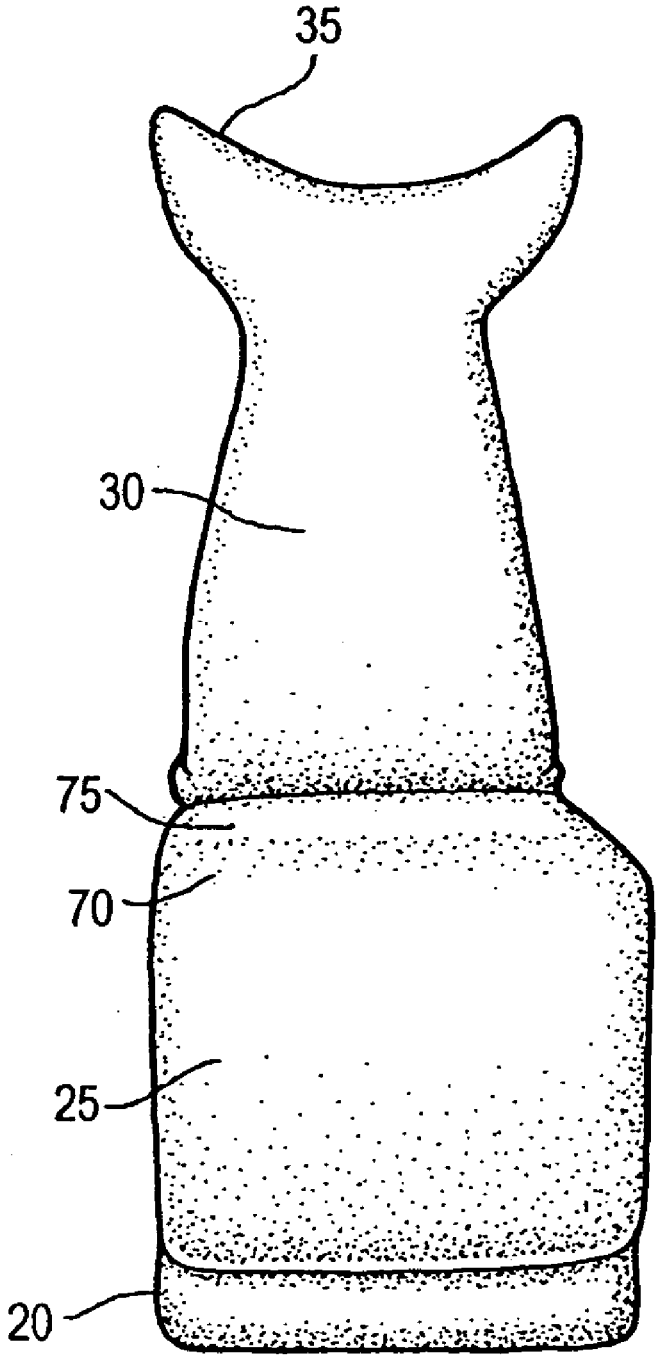
FIG. 3 is a front view of a furniture piece, according to one preferred embodiment of this invention.
Figure 5:
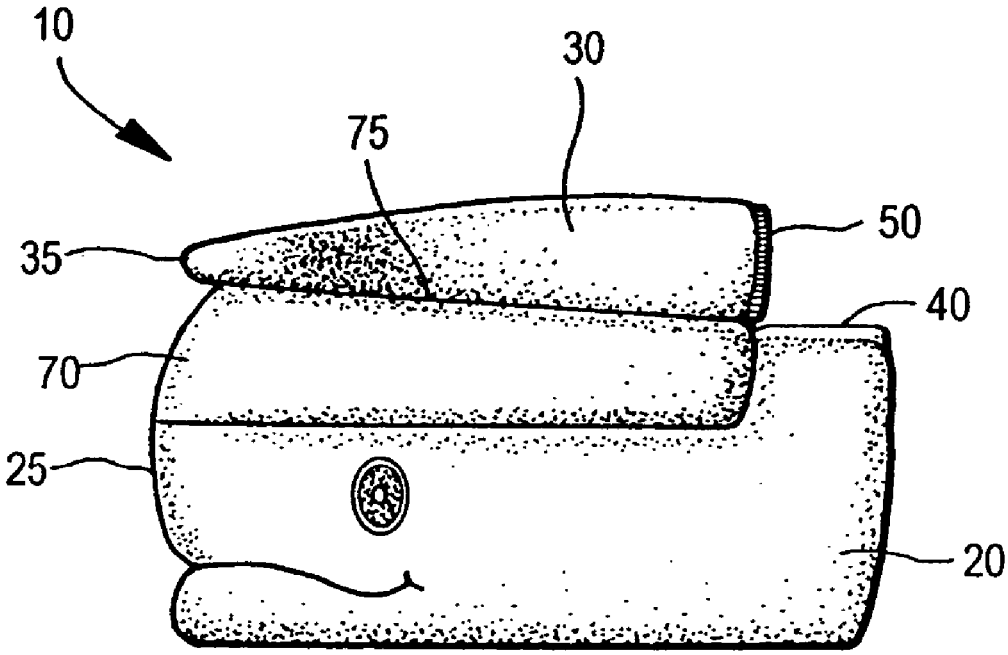
FIG. 5 is a side view of a furniture piece including a backrest positioned with respect to a base in a folded position, according to one preferred embodiment of this invention.

In one preferred embodiment of this invention, an attachment mechanism or component 40 is operatively connected with respect to backrest 30. Attachment component 40 is preferably attached or connected to backrest 30 using any suitable attachment or connection. For example, as shown in FIG. 2, attachment component 40 is sewn into backrest 30. Other suitable attachment or connection mechanisms, such as an adhesive attachment and/or a hook-and-loop attachment, may be used to attach or connect attachment component 40 with respect to backrest 30. Attachment component 40 preferably comprises at least one zipper 50, as shown in FIG. 2, that is positionable or movable between a closed or engaged position and an open or disengaged position. In the engaged position, attachment component 40 locks or secures backrest 30 in the upright position with respect to base 20. With backrest 30 in the upright position, a user can sit on furniture piece 10 and comfortably rest against backrest 30. With attachment component 40 in the disengaged position, backrest 30 can be moved or pushed towards base 20, allowing the user to fold backrest 30 to a folded position with respect to base 20, as shown in FIG. 5, for easy and efficient shipment and/or storage of furniture piece 10.

Referring to FIG. 2, in one preferred embodiment of this invention wherein attachment component 40 comprises zipper 50, the engaged position corresponds to zipper 50 being zipped or closed and the disengaged position corresponds to zipper 50 being unzipped or open. Other suitable attachment mechanisms or components can be used to position backrest 30 with respect to base 20, such as at least one snap, at least one button and/or at least one hook-and-loop fastener component, such as a VELCRO fastener component.

Figure 4:
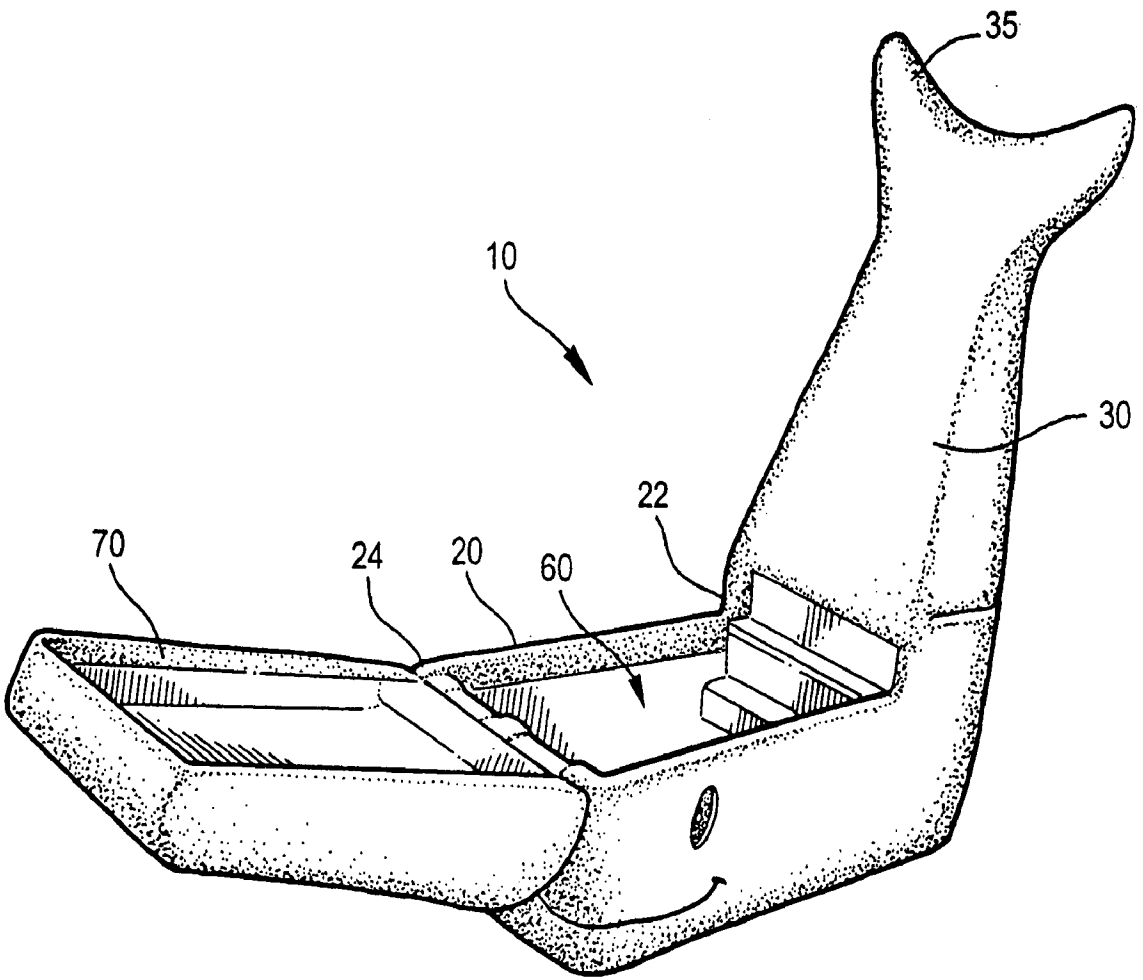
FIG. 4 is a front perspective view of a furniture piece including a seat portion in an open position, according to one preferred embodiment of this invention.

Preferably, furniture piece 10 comprises a compartment 60 formed by or within base 20, as shown in FIG. 4. In one preferred embodiment of this invention, furniture piece 10 further comprises a seat portion 70 pivotally connected to a second end portion 24 of base 20 and positionable with respect to compartment 60 formed by base 20. Seat portion 70 can be pivotally connected to base 20 using any suitable mechanical connection that allows seat portion 70 to pivot or otherwise move with respect to base 20, such as one or more hinges. Seat portion 70 is pivotally movable with respect to base 20 between an open position, as shown in FIG. 4, and a closed position, as shown in FIGS. 1–3 and 5, wherein seat portion 70 covers at least a portion of compartment 60. In an alternate embodiment of this invention, seat portion 70 is integrated with or fixedly attached or connected to base 20.

Backrest 30 is preferably foldable with respect to base 20 to allow for easy shipping and/or storage of furniture piece 10. In one preferred embodiment of this invention as shown in FIG. 5, seat portion 70 is in the closed position with respect to base 20 and with backrest 30 in the folded position, at least a portion of backrest 30 contacts seat portion 70. For example, backrest 30 can be folded so that at least a portion of backrest 30 contacts a top or seating surface 75 of seat portion 70. In the folded position, preferably but not necessarily, a top 35 of backrest 30 is generally coterminous, aligned or flush with a front 25 of base 20. The term coterminous as used throughout this specification and in the claims refers to a portion or component of the furniture piece having a common or corresponding boundary with at least one other portion or component of the furniture piece.

In an alternate preferred embodiment of this invention, in the folded position, backrest 30, compartment 60 and/or seat portion 70 are designed, dimensioned and configured so that at least a portion of backrest 30 is contained or positioned within compartment 60. Preferably, in this embodiment backrest 30 is entirely contained within compartment 60 and seat portion 70 is positioned in the closed position with respect to compartment 60 to cover backrest 30 in the folded position.

Referring to FIGS. 1–5, furniture piece 10 can be folded to provide for easy shipping and/or storage. Backrest 30 is unlocked from the upright position by positioning or moving attachment component 40 from the engaged position to the disengaged position. For example, zipper 50, as shown in FIG. 2, is unzipped from the engaged position. With attachment component 40 in the disengaged position, the user can move or push backrest 30 towards the folded position and fold backrest 30 with respect to base 20, as shown in FIG. 5. Backrest 30 is folded to contact seating surface 75 of seat portion 70 so that top 35 of backrest 30 is generally coterminous, aligned or flush with front 25 of base 20. In an alternate preferred embodiment of this invention, backrest 30 is folded into and positioned within compartment 60, and seat portion 70 is closed by pivotally moving seat portion 70 with respect to base 20 from the open position, as shown in FIG. 4, to the closed position to cover backrest 30. In the folded position, furniture piece 10 can be placed in a suitable package for shipping and/or storage, such as a box or other suitable packaging, particularly in a volume-efficient manner that saves significant shipping costs.

While in the foregoing specification this invention has been described in relation to certain preferred embodiments, and many details are set forth for purpose of illustration, it will be apparent to those skilled in the art that this invention is susceptible to additional embodiments and that certain of the details described in this specification and in the claims can be varied considerably without departing from the basic principles of this invention.

What is claimed:

1. A furniture piece comprising:

a base;

a backrest pivotally connected to the base along a front portion of the backrest, the backrest pivotally movable between an upright position and a folded position; and a first attachment component extending along at least a portion of a first side portion of the backrest, a back portion of the backrest, and at least a portion of a second side portion of the backrest opposing the first side portion, and a second attachment component extending along at least a portion of a first side portion of the base, a back portion of the base, and at least a portion of a second side portion of the base opposing the first side portion, the first and second attachment component positionable between an engaged position locking the backrest in the upright position and a disengaged position allowing the backrest to move towards the folded position.

2. The furniture piece of claim 1 wherein the base forms a compartment.

3. The furniture piece of claim 1 further comprising a seat portion pivotally connected to the base, and the seat portion pivotally movable with respect to the base between an open position and a closed position.

4. The furniture piece of claim 3 wherein, in the folded position, at least a portion of the backrest contacts the seat portion in the closed position.

5. The furniture piece of claim 1 wherein the first and second attachment component comprises at least one of at least one snap, at least one button, at least one zipper and at least one hook-and-loop fastener.

6. The furniture piece of claim 1 wherein, in the folded position, a top of the backrest is generally coterminous with a front of the base.

7. The furniture piece of claim 1 wherein the base and the backrest form one of a chair, a couch and a sofa.

8. A furniture piece comprising:

a base;

a backrest pivotally connected to the base along a front portion of the backrest, the backrest pivotally movable between an upright position and a folded position;

a first attachment component extending along at least a portion of a first side portion of the backrest, a back portion of the backrest, and at least a portion of a second side portion of the backrest opposing the first side portion, and a second attachment component extending along at least a portion of a first side portion of the base, a back portion of the base, and at least a portion of a second side portion of the base opposing the first side portion, the first and second attachment component movable between an engaged position locking the backrest in the upright position and a disengaged position allowing the backrest to move towards the folded position; and a seat portion pivotally connected to the base and movable with respect to the base between an open position and a closed position.

9. The furniture piece of claim 8 wherein, in the folded position, at least a portion of the backrest contacts a seating surface of the seat portion in the closed position.

10. The furniture piece of claim 8 wherein, in the folded position, a top of the backrest is generally flush with a front of the base.

11. The furniture piece of claim 8 wherein the base forms a compartment.

12. The furniture piece of claim 8 wherein the first and second attachment component comprises a zipper.

* * * * *